United States Patent [19]

Fiore et al.

[11] 4,176,668

[45] Dec. 4, 1979

[54] NOVEL RECONSTITUTED TOBACCO SHEETS AND PROCESS

[75] Inventors: Joseph V. Fiore, Fairfield; John M. Slanski, Trumbull, both of Conn.

[73] Assignee: AMF Incorporated, White Plains, N.Y.

[21] Appl. No.: 793,232

[22] Filed: May 2, 1977

[51] Int. Cl.[2] ..... A24B 3/00; A24B 3/14

[52] U.S. Cl. ..... 131/17 A; 131/140 R; 131/140 C; 106/194; 427/9

[58] Field of Search ..... 131/17, 15 C, 140 R, 131/140 C; 427/9; 106/194

[56] References Cited

U.S. PATENT DOCUMENTS

| | | | |
|---|---|---|---|
| 1,885,878 | 11/1932 | Whitehead et al. | 106/194 |
| 2,390,512 | 12/1945 | Collins | 106/194 |
| 2,445,374 | 7/1948 | Wyck | 106/194 |
| 3,534,743 | 10/1970 | Monte | 131/15 C |

FOREIGN PATENT DOCUMENTS

| | | | |
|---|---|---|---|
| 793354 | 4/1958 | United Kingdom | 106/194 |
| 1158512 | 7/1969 | United Kingdom | 106/194 |
| 1353635 | 5/1974 | United Kingdom | 106/194 |

*Primary Examiner*—Robert W. Michell
*Assistant Examiner*—J. Millin
*Attorney, Agent, or Firm*—George W. Price; Charles J. Worth

[57] ABSTRACT

Reconstituted tobacco sheet coated with a hydrophobic coating containing a spectrophotometrically-determinable metal cation, including the process of making such products and the process of monitoring the coating process to assure even distribution of coating on tobacco sheet.

23 Claims, No Drawings

NOVEL RECONSTITUTED TOBACCO SHEETS AND PROCESS

BACKGROUND OF THE INVENTION

1. Field of the Invention

This invention relates to the processing of reconstituted tobacco sheet, and, more particularly, to control of processes for applying hydrophobic coatings to such sheet and the hydrophobic coatings useful therefor, as well as tobacco sheets produced for such control and smoking products produced therefrom.

2. Description of the Prior Art

The application of hydrophobic coatings to the surface of reconstituted tobacco, in general, and particularly reconstituted cigar wrappers, is well known and is described, for example, in U.S. Pat. Nos. 3,185,161; 3,185,162; and 3,534,743. Briefly, the hydrophobic coating imparts to the reconstituted tobacco the desired property of a marked increase in resistance to moisture penetration which is reflected in less stickiness of the tobacco surface on exposure to the smoker's lips and less tendency to disintegrate in the mouth, particularly when the reconstituted tobacco products have been formulated with water-soluble or hydrophilic binders. For optimum performance, the hydrophobic coatings should be applied as discrete filsm within a relatively narrow range of application levels. If applied at a higher than needed rate, there may be adverse effects on automatic apparatus used in production thereof, undesirable slipping of smoking products in the smoker's mouth or changes in the smoking characteristics.

Thus, it is extremely important to be able to accurately control the levels at which the hydrophobic coatings are applied to tobacco sheet. However, such control is not easily achieved since the determination of coating levels necessarily implies the measurement of two parameters: (1) the coating efficiency, and (2) the coating quantity.

Coating efficiency tests are a measurement of the functionality (i.e., expected performance) of the coating and are, at best, relatable to coating quantity only in a semi-quantitative way. Coating quantity, on the other hand, may be an absolute measurement but may have no bearing at all to coating efficiency or functionality.

An example will serve to demonstrate the point: A reconstituted tobacco sheet with a dry sheet weight of 5 g./ft$^2$ is sprinkled with 30 mg. of ethyl cellulose powder (a hydrophobic cellulose polymer) per ft$^2$ just before the sheet is completely dry. The hydrophobicity of this "coated" sheet would be minimal compared to a similar sheet made by depositing 30 mg. of ethyl cellulose dissolved in 95% isopropanol per ft$^2$ of dry sheet. In this latter case, the ethyl cellulose has been applied as a film and not as a powder. Therefore knowing the exact quantity of coating indicates little about the physical state of particle distribution which is directly relatable to the efficiency of the coating. Thus, the monitoring of effective coating levels on reconstituted tobacco products must include not only the absolute amount of the material applied but also the efficacy or efficiency of the hydrophobic barrier. This complicates the quantitative procedures since all procedures will relate to one or the other but not both factors involved in coating level determinations. For this reason, empirical methods must be used to establish the correlation between quantity and efficiency. For example, reconstituted products are prepared with known coating levels and these samples are then subjected to some form of efficiency test. After a correlation is established, the efficiency test is used to monitor the coating quantity off-line, either on the sheet or on the finished product.

Prior to the present invention there has been used a very subjective "lip-adhesion test" which on numerous repetitive trials has been found to be consistently reproducible and correlateable to coating quantity. This test has therefore been used as a quality control test to monitor coating quantity. Thus, experience over the years has indicated how to lay down an efficient coating or hydrophobic barrier on reconstituted tobacco products but the exact, quantitative correlation with coating quantity has only been semi-quantitative as determined by the "lip-adhesion" tests which only yield results in approximate ranges of actual coating quantity, i.e., as described by "low, medium or high", or "acceptable, borderline or unacceptable". Exact quantitation of the coating level has been missing as a production quality assurance test or product quality control test.

Various attempts have been made to evaluate coating efficiency on tobacco sheet material but, up to the present invention, these have not yielded the necessary quantitative parameters. Tests predicated on penetration of the tobacco sheet as by moisture, frictional resistance of the coated surface of the sheet, the time of travel of water droplets on an inclined plane of the coated tobacco sheet, and similar such tests, yield results which are not reproducible and, for the most part, lack quantitation. At best, the results obtained with such methods could be used only to distinguish between coated and uncoated sheets.

Coating quantity determinations also are subject to inconsistency. Usually, the best approach to quantification of a material is by direct analysis. However, with cellulose derivatives being preferred for coating tobacco sheet, attempts at analyses have been less than successful since they must be based on total carbohydrate content of the coated sheet from which is deducted the natural tobacco carbohydrate content, the remaining carbohydrate corresponding to the coating cellulose derivative. Unfortunately because of the low level of coating employed, the actual weight of coating carbohydrate is usually within the experimental error of such determination. Another method of quantifying the coating involves coating a fixed length of the stainless steel belt under the same conditions as coating tobacco sheet and removing the coating from the belt, drying and weighing. This would yield the expected amount of coating in units of weight per unit area. This approach suffered from a number of disadvantages, particularly lack of reproducibility and the lack of a quality control method for coating level on samples of sheet returned from the field.

Further attempts to quantify coating included the use of a dye, e.g. Du Pont Victoria Green, in the coating composition at a known concentration and visual observation of the distribution of the coating on the sheet during production. This is disadvantageous since production must be interrupted in order to perform the test and no quality control was provided in that field samples could not be monitored by this technique.

Tracer technology has been used in the field of analytical chemistry as an indirect means of quantifying a material difficult to quantify by direct methods. It is known that zinc oxide has been used as a tracer for on-line, non-destructive testing of coating weight in papermaking processes using X-ray fluorescent instrumentation as the means of detection (see F. P. Arendt and W. D. Gleson—TAPPI 58 96, 1975). According to this article, zinc oxide is added to the coating color at levels of 0.5–1.0%. Samples of reconstituted tobacco sheet containing zinc at levels of even as high as 3% were analyzed with an X-ray fluorescent instrument and it was found that the instrument was not sensitive enough to pick up such levels of zinc on the tobacco sheet, nor was it able to discriminate from the background zinc, i.e. zinc salts naturally occur in tobacco.

Tobacco being a very complex chemical and biochemical entity which is usual for natural materials of plant origin has presented substantial problems not only in direct analysis but also indirect analysis. Thus, attempts at the usual tracer techniques have been unsuccessful, mainly because of background interferences from the tobacco itself. Even the use of fluorescent tracer techniques which are extremely sensitive and often yield detection levels in the order of parts per billion were found to be inapplicable. For example, riboflavin (vitamin B2) is fluorescent in solution and it was expected that the presence of riboflavin in the coating solution should provide an easily analyzable tracer. However, it was found that background fluorescence of the tobacco made it impossible to accurately assess levels of the tracer.

It is known that tobacco contains various metallic constituents, including cobalt and zinc, at levels of about 0.2 to 7 ppm and about 24 to 53 ppm, respectively, as well as other metals as described by R. A. Nadkarni, Chemistry and Industry, page 693, September 1974. The same article reports a transfer of cobalt and zinc to smoke condensate of 4.2% and 2.7% respectively. Thus, low levels of cobalt and zinc are present in tobacco and the amounts of such metals carried over into smoke are even less.

As shown in U.S. Pat. Nos. 3,654,109 and 3,734,620, the use of atomic absorption spectroscopy is a well-known technique. U.S. Pat. No. 3,654,108 describes the use of atomic absorption spectroscopy in measuring the thickness of a metal coating deposited on a stationary substrate from the vapor phase. U.S. Pat. No. 3,734,620 shows the use of atomic absorption spectroscopy in measuring certain properties of materials such as temperature and density.

U.S. Pat. No. 3.016,460 describes the use of multistation radiation gauges to measure wet thickness.

The quantity per unit area of coatings on reconstituted tobacco sheet when prepared on commercial scale can vary appreciably. Such factors as wear of the doctor blade edge, bearings, and coating rollers, and loss of mechanical alignment can appreciably affect the weight per unit area of the coating. These variations can be responsible for uneven distribution of the coating across the width of tobacco sheet, as well as along the length of the sheet. Even employing as strict controls as heretofore possible, such variations normally amount to at least about 40%, and usually range from 40 to 80%, and sometimes 100%. Naturally, since coating of tobacco sheets is accomplished by relatively high speed belt application, there is an inherent tendency for somewhat larger quantities of coating material to deposit at the edges of the belt than at the center so that the distribution of coating across the width of the tobacco sheet is not even, but this inherent variation from center to edge is within tolerable limits. The present invention however does provide monitoring means for variations which exceed these inherent increments from the central regions to the outer periphery of the sheet. Control of such variations have heretofore been unsuccessful because of the lack of analytical procedures which permit accurate measurement of such coating weights within reasonable time periods.

SUMMARY OF THE INVENTION

This invention provides a process for monitoring the weight per unit area of hydrophobic coatings by measurement of the metal content in the coating using spectrophotometric analysis.

The process of this invention is accomplished by incorporating a metal salt into the coating composition used to form the hydrophobic coating on the sheet, the metal of the salt being spectrophotometrically determinable, and measuring the metal content of the coating on a spectrophotometer. The measurement of metal content of the coating on the sheet can be accomplished by any convenient method.

A particularly effective method involves cutting samples of known area from the coated sheet, extracting the metal from the sample using solvents for the metal, and finally spectrophotometrically analyzing the filtered extract for metal. Using this approach, sample sections of the coated tobacco sheet can be taken across the width to obtain a coating profile curve, and along the length of the sheet to obtain a machine direction profile.

Thus, by monitoring the weight per unit area of the coating on tobacco sheet, using coating profile and machine direction profile determinations, as coating weight varies in either direction, adjustments in the coating apparatus can be made to counteract the variation. Of course, the variations can normally be detected before they cause appreciable change in distribution of the coating, i.e. the onset of variation is detectable and simple adjustment can be made to assure proper coating levels throughout the tobacco sheet without interruption of finished sheet production. Employing the present process, tobacco sheet is produced in which the variation in the weight per unit area is not greater than 5% in the machine direction. Such control over coating of tobacco sheet has not heretofore been possible, the usual coating methods resulting in variations of about 40% to about 80%.

The procedure for determination of the metal levels in the coating, of course, must take into account the presence of the same metal in the tobacco sheet since normally selection of the coating metal would dictate the use of a metal present in tobacco, for reasons detailed hereinafter. Thus, the final determination of absolute metal content of the coating is based on correction of the total level detected spectrophotometrically by subtraction of the natural level of the metal in the tobacco sheet. The natural metal content of tobacco sheet can of course be determined by merely extracting the metal from the uncoated sheet and then measuring the amount thereof using the same spectrophotometric method.

Spectrophotometric analysis can be accomplished by any of several methods such as by flame emission and by atomic absorption. Normally, the spectrophotometer employed for atomic absorption determination can also be used for flame emission determination. Accordingly, the spectrophotometer can be used in one mode or the other, depending on which mode provides the necessary sensitivity.

The method of measurement by atomic absorption spectroscopy is well known and described, for example, by Kahn and Slavin, Applied Optics 2, 931 (1963). Typically, a sample to be measured is converted to an atomic vapor, usually in a flame, and the measurement of the amount of light absorbed at certain specific wavelengths by the atomic vapor will give an indication of the sample content of a particular element. Flame emission determinations are made in analogous manner with the spectrophotometer in the flame emission mode.

DESCRIPTION OF PREFERRED EMBODIMENTS

The metal cation employed in the present invention should be spectrophotometrically-determinable and pharmacologically-acceptable. By "pharmacologically-acceptable" is meant that the metal cation is non-toxic to the smoker, e.g. is fit for human consumption. By "spectrophotometrically determinable" is meant that the metal cation can be accurately measured on a spectrophotometer as by flame emission or atomic absorption.

The selection of the metal to be incorporated into the coating on the tobacco sheet must take into account the end-use of the coated tobacco sheet, i.e. smoking products. From the viewpoint of obvious practical requirements, the metal of the salt should preferably be readily determinable, even in the presence of other materials; should have properties similar to the material of the coating, such as solubility and distribution characteristics; and should be economical and readily available. Aside from these practical requirements, because the salt remains in the coating on the tobacco sheet, and thus in smoking products produced therefrom, the metal salt should be "pharmacologically-acceptable", that is it should be non-toxic, and should not appreciably change the physical characteristics of the coating such as taste, appearance, etc. The salt should preferably be stable under field conditions so that it can be analyzed at any time after manufacture of the smoking product, and should not adversely affect machine performance of the product on automatic production apparatus. The most-desirable metal salts are those which show a low % carryover into tobacco smoke and preferably are salts of metals commonly found in natural tobacco, i.e. tobacco-acceptable salts.

Exemplary metal cations for use in the present invention include zinc, lithium, cesium, copper and barium, in the order of preference. Non-toxic salts such as the sulfate, chloride, oxalate, stearate, gluconate, acetate, carbonate and the like may be employed. It is well known that soluble barium salts or salts converted to soluble salts in digestion are undesirable for human consumption and should be avoided. For this reason, the selected barium salt is the sulfate which is insoluble and not converted to soluble salts in the digestive system. For the remaining metal cations, salts with inorganic and organic acids can be employed, but of these the inorganic acid salts are preferred since they show a low % carryover into smoke from the smoking product whereas the organic acid salts appear to have a higher volatility and show appreciably higher % carryover into smoke. It is preferred to use the following salts of the said metals which are not objectionable for human consumption: zinc chloride, sulfate, oxide, gluconate, acetate or carbonate, copper iodide, barium sulfate, copper gluconate, cesium chloride, and lithium carbonate. Of these salts, the most preferred are zinc salts, and of these, zinc chloride is particularly preferred.

The concentrations of the preferred metal salts in tobacco are: Zn (30–80 ppm); Cu (20–50 ppm); Cs (1 ppm); Li (0); and Ba (84 ppm). The preferred detectable levels of each in the coated sheet are: Zn (200–400 ppm); Cu (200–300 ppm); Cs (500–600 ppm); Li (150–250 ppm); and Ba (200–500 ppm). Concentrations of the selected salts to provide the aforesaid detectable levels of metal are employed in the coating composition for application at desired coating levels. At these levels, atomic absorption measurement is sufficiently sensitive for all metals whereas flame emission measurement can also be effectively used with lithium and cesium as the coating additive metal with excellent reproducibility.

The particularly preferred salts are cuprous iodide, zinc chloride, cesium chloride, lithium carbonate and barium sulfate which appear to give best results. The salts employed are preferably of USP grade in fine particle size. Preferably, the particle size is less than about 100 microns, most preferably, about 25 to about 50 microns.

The invention will be particularly described with reference to zinc chloride as the metal salt additive to the hydrophobic coating but it will be understood that the remaining metal salts will be employed in essentially the same manner, with optimization being realizable by a minimum of routine experimentation.

A variety of hydrophobic materials can be employed for the basic coating compositions and these usually are cellulosic derivatives such as cellulose ethers and nitrocellulose. The most preferred of the cellulose derivatives is ethylcellulose which is most commonly used in the production of reconstituted tobacco sheet. The methods of applying the hydrophobic coating are widely known to those skilled in the art and should not require exhaustive presentation for the purpose of this disclosure. In general, the cellulose derivative is dissolved in a suitable solvent to form a flowable coating mixture which is applied to the tobacco sheet using, for example, a doctor blade or similar device for controlling the quantity of the coating applied. Accordingly, the tobacco sheet is carried on belt conveyors, such as stainless steel conveyors, through an application station where the coating is applied and the coated sheets are then dried, e.g. by air convection or oven drying, while on the moving belt, after which they are stripped from the belt and taken up on a suitable roller for storage and eventual use in cigar-making.

For production of the novel coating compositions of the present invention, zinc chloride is added to the ethyl cellulose coating composition which is then applied to the tobacco sheet using routine coating procedures. For this purpose, the solvent employed for the coating composition should preferably dissolve zinc chloride at the concentrations employed, although the salt can be effectively dispersed in a solvent which dissolves the ethyl cellulose but not the zinc chloride, as long as the dispersion remains uniform until the coating is applied to the tobacco sheet.

A variety of solvents can be employed to dissolve the coating material, ethyl cellulose, such as aromatic hydrocarbons, e.g. toluene and benzene, in admixture with polar solvents such as lower alcohols, e.g. methanol, ethanol, isopropanol and the like, acetone, tetrahydrofuran and dioxane; the lower alcohols, preferably aqueous; halogenated hydrocarbons, such as methylene chloride, ethylene chloride, etc.; dioxane; tetrahydrofuran; and similar such solvents. The preferred solvents are water-miscible and the preferred solvent systems for the present coating compositions are aqueous solvents preferably containing up to about 30–40% water by volume, especially aqueous alcohol solvents. Aqueous isopropyl alcohol is a preferred solvent since it dissolves zinc salts and is an excellent solvent for ethyl cellulose.

The level of zinc in the coating composition should be at least that which will be detectable in the coating using spectrophotometric measurement. For most purposes, a ratio of at least about one part of zinc to about 100 parts of hydrophobic coating should be employed to permit ready detection using presently available spectrophotometers. For most purposes, it is practical to employ a level of metal which is at least about three times the natural level of metal in the tobacco of the sheet, with a preference for about 4 to 6 times the said level. For cesium and lithium which are present in tobacco in only detectable amounts, if at all, the levels employed are about the same as zinc levels. For best results, the readily detectable levels of the metals in the coating are: Zn, 150 to 400 ppm; Cu, 200 to 300 ppm; Cs, 400 to 600 ppm; Li, 150 to 250 ppm; and Ba, 100 to 450 ppm. Lithium cation is especially sensitive in the atomic absorption mode of the spectrophotometer and small sample sizes are preferred because of this sensitivity. Cesium is preferably measured using the flame emission mode especially when used at the 500 to 600 ppm level, since excellent reproducibility of results is obtained. Generally, ratios of 1:30 to about 1:80 parts of coating provides an efficient level of zinc for present purpose, since such levels are readily detectable and convertible to coating weight and distribution. Optimum levels of the metal employed are readily determinable with minimum experimentation and will be determined by the size of sheet sample taken, the sensitivity of the metal, the level of the metal in the coating and similar considerations. With lower level of metal and lower sensitivity of the metal, larger sample size of the sheet should be taken. The amount of salt added will therefore be predicated on the desired level of coating, the sensitivity of the metal to the spectrophotometric analysis, the sample size, etc. For most purposes, the metal concentration in the coating composition is adjusted to provide the preferred detectable levels of selected metal described hereinbefore.

Before the tobacco sheets are coated, samples of the uncoated sheet are analyzed for zinc content, knowledge of which is necessary for conversion of actually detected zinc into levels of zinc in the coating. Such determination is preferably made by atomic absorption spectroscopy, i.e. by extraction of the zinc values from the uncoated tobacco sample and analysis of the extract in a suitable spectrophotometer.

The coating operation is monitored by measuring the zinc content of the coating by taking samples of the coated tobacco sheet, extracting the samples with a solvent for the zinc values in the coated tobacco and thereafter measuring the zinc values of the extract in a suitable spectrophotometer. After correction for background zinc, i.e. zinc in the tobacco sheet, the actual zinc content of the coating is obtained.

Procedurally, the test samples are extracted with a known volume of the selected zinc solvent. To assure dissolution of the zinc values from the sample, it is preferable to allow the samples to stand in the solvent with at least occasional stirring for a period of about 30 minutes, after which the liquid phase is filtered clear of the solid phase and then analyzed. For convenience, the solution can be aspirated directly into an atomic absorption spectrophotometer (single or double beam) that has been appropriately calibrated for zinc and is operating in the zinc mode. Knowing the area and weight of the sample plus the consideration of dilution factors, the zinc content can readily be calculated on the basis of area or in parts per million of sheet, after correction for background zinc.

The zinc solvent employed in the extraction step can be water which preferably contains a mineral acid such as hydrochloric acid, nitric acid, sulfuric acid, and the like, but the extraction of the zinc values from the hydrophobic coating may require long extraction periods which can be shortened by macerating the test samples. For convenience, and to shorten the extraction time period, it is preferable to incorporate a solvent for the coating, i.e. ethyl cellulose, which also dissolves the zinc values. The water-miscible solvents employed in the novel coating compositions of this invention can also be employed for this purpose. Isopropyl alcohol is particularly suited and is preferred. To maximize the dissolution of the hydrophobic coating, it is preferred to employ a major proportion of isopropyl alcohol in the zinc solvent system, the remainder being water containing, for example, hydrochloric acid. The exact ratios of water, acid and isopropyl alcohol are not critical. A preferred zinc solvent is water, concentrated hydrochloric acid and isopropyl alcohol in the ratio of about 10:15:75 or 5:20:75. Of course, the water employed in the zinc solvent should be deionized or distilled water.

Analysis of the smoke produced with cigars wrapped with sheets of tobacco coated with zinc-containing ethyl cellulose indicates that the % carryover of zinc into the smoke is of the same order as cigars which contain no added zinc in the wrapper coating. Thus, with amounts of added zinc up to about ten to twenty times to normal level of zinc contained in tobacco, there is no apparent large increase in percentage of zinc carryover over that obtained in the control indicating that the added zinc undergoes the same combustion pattern as the control.

The present invention is particularly efficacious in providing quality control means for tobacco sheet material in the field, either in sheet form or in finished smoking product form. The coating of the reconstituted tobacco sheet retains the added zinc and thus can be analyzed for coating thickness at any time. The analysis of course is based on the sampling technique described hereinbefore. Thus, the improvement of the presence of zinc in the coating layer is not only effective in monitoring of the coating procedure but also provides the added advantage of the capability of quality control after the sheet is in the field, even in the final form of smoking products, i.e. wrapped cigars.

The new and useful coated tobacco sheets produced in accordance with the present process show a variation of less than about 5% in coating weight per unit area in the machine direction even for tobacco sheets of more than 3000 feet in length. In practice, with monitoring of the coating process by the present process, tobacco sheet is continuously coated and sample specimens are removed from the final coated sheet. Sample specimens are cut out of the sheet, e.g. by using a template which cuts out a specific area of sheet. The specimens are then extracted with a zinc solvent and the amount of zinc extracted is determined by atomic absorption spectroscopy. Sample specimens are taken along the length of the coated sheet in the machine direction and comparison of the zinc content per unit area of these samples shows no appreciable variation, i.e. ±5%, in the machine direction. Similarly, samples of the coated sheet are taken across the width of the coated sheet and variations in the quantity of coating per unit area are detected when present, as described in Example 2 which follows. Such substantial uniformity of coating on tobacco sheet, i.e. ±5%, has not heretofore been possible, with the prior art variations ranging from about 40% to about 80%. Thus, the present coating process, and the coated sheets produced thereby, are of higher order of efficacy and efficiency than previously obtained.

The detailed procedure for determination of coating quantity according to the present invention is described in the following examples which further illustrate the invention.

EXAMPLE 1

A zinc-containing coating solution is prepared by making up a mixture of zinc chloride and ethyl cellulose in isopropyl alcohol so that the calculated ratio of zinc to ethyl cellulose is 1/66 parts by weight.

The coating solution is made up to 5.9% by weight based on the ethyl cellulose as follows:

| | |
|---|---|
| Isopropyl alcohol, 95% by volume | 285.0 lbs. |
| Ethyl cellulose, (HERCULES grade K200) | 18.0 lbs. |
| Zinc chloride, (grade U.S.P.) | 254 grams (0.56 lbs.) |
| Water: at 100–110° F. | 0.5 lbs. |
| | 304.06 lbs. |

The make-up procedure is as follows:

(1) Charge the proper amount of isopropanol (IPA) to the make-up tank.

(2) Dissolve the required amount of zinc chloride in the total amount of water at 100°–110° F. and add to the IPA with mild agitation. Rinse the container twice with about 100 cc. of IPA from the make-up tank to insure complete transfer of the zinc chloride.

(3) Add the K200 grade ethyl cellulose and complete the solution.

Upon analysis of the coating solution, however, it is found that the actual ratio of zinc to ethyl cellulose is 1/71.7 and this is the actual ratio used for calculating the zinc-traced coating level.

The zinc-traced coating solution is applied, preferably by single or double roll-coating, during the manufacture of reconstituted tobacco sheet, for example, a reconstituted sheet that is to be used as a cigar wrapper. The example described in U.S. Pat. Nos. 3,185,161 and 3,185,162 describes the procedure and is incorporated herein by reference for the said disclosure.

Just prior to the start of the application of coating, samples of uncoated sheet are obtained and used to establish the zinc level in the uncoated product which will then serve as a background correction in the actual zinc coating analysis. Samples can now be retrieved during and at any time after production to establish coating quantity by reference to a zinc analysis performed by atomic absorption spectrophotometry. In this fashion, the coating quantity is monitored during production by taking samples across the width of the stainless steel belt as well as in the direction of travel. Adjustments in coating equipment are made to compensate for any variations in coating distribution.

EXAMPLE 2

Six separate reconstituted cigar wrapper production runs are monitored to assess the coating quantity across the belt-width in order to analyze the efficiency of single vs. dual roll coaters. In this case, three different zinc salts are used to trace the coating which is prepared at 5% solids using ethyl cellulose (Hercules K-5000). In all cases, the solutions are made up with a desired ratio of approximately 1/30, Zinc/EC. The runs are summarized as follows:

| Run # | Tracer | Coating Application | Calculated Ratio[1] | Actual Ratio[2] |
|---|---|---|---|---|
| 84-1 | Zinc Nitrate | Single Coater | 1/31.16 | 1/33.03 |
| 84-2 | Zinc Nitrate | Dual Coater | | |
| 84-3 | Zinc Acetate | Single Coater | 1/31.06 | 1/35.33 |
| 84-4 | Zinc Acetate | Dual Coater | | |
| 84-5 | Zinc Chloride | Single Coater | 1/30.95 | 1/32.94 |
| 84-6 | Zinc Chloride | Dual Coater | | |

[1]Calculated at time of solution make-up.
[2]Actual ratio obtained by direct analysis of the zinc-traced coating solution.

In Table 1 are presented the coating levels as determined by analysis of the zinc in the coated sheet. The analytical method is described hereinafter. Inspection of Table 1 immediately indicates the need to adjust the coating application, since, in most cases, coating is heavier at the edges than in the center of the mill roll. This is especially true with the single roll coater.

EXAMPLE 3

Zinc-traced coated sheets are prepared as described in Example 1 in which the application of the coating quantity was varied, e.g., between 0 and 100 mg. of coating (EC) per sq. ft. of dry sheet. Sheet weight determinations are carried out on the same samples on which zinc analyses are performed. In this manner the exact amount of coating per known quantity of sheet as well as the zinc content of a known quantity of sheet can be calculated—for example:

(a) A coating solution is prepared and found to contain a ratio of zinc to EC of 1/66 and was used to coat a reconstituted cigar wrapper. Analysis of a piece of the finished sheet yielded a sheet weight of 3.1 gm/sq. ft. and a zinc analysis indicated a coating quantity of 44 mg./sq.ft. This wrapper contained 14 mg. of coating per gram of dry sheet and 212 ppm of zinc as added zinc.

Using this technique, samples of sheet are prepared at different coating levels, conditioned at 72° F. and 60% RH for at least 48 hours and were then subjected to "the lip-adhesion test" in order to relate actual measured quantity of coating to coating efficiency. Thus, it is established on repeated tests that with a sheet weight of approximately 3.0 g./sq.ft., the following relationships existed:

| Coating Quantity mg./sq. ft. | Lip-Adhesion Rating |
|---|---|
| 0–10 | Unacceptable |
| 10–20 | Poor |
| 20–40 | Fair to Good |
| 40–60 | Good |
| 60+ | Excellent |

The above relationships are found to vary only slightly with formula modifications. Thus coating efficiency is related to coating quantity.

EXAMPLE 4

Zinc-traced coated sheets are prepared as described in Example 1 and subjected to zinc analysis by atomic absorption spectroscopy. The analytical method consists in extracting a known area and quantity of sheet with a known volume of "zinc solvent" for a selected time period. The "zinc solvent" is prepared by mixing concentrated hydrochloric acid, deionized or distilled water and 95% isopropyl alcohol in the ratio of 10:15:75 by volume and storing in a ground glass stoppered bottle.

Using an appropriate template (i.e., of known area) samples are cut as desired e.g., equally spaced across the width of the sheet during production (this yields a coating profile curve) or equally spaced down the length in the machine direction (this gives a machine direction profile) or any combinations of these two or samples may be obtained from wrappers removed from cigars when returned from the field. The samples are then transferred to test tubes and a known volume of the "zinc solvent" is added. The samples are occasionally stirred and allowed to stand for 30 minutes. The solution is then aspirated directly into an atomic absorption spectrophotometer (single or double beam) that is appropriately calibrated for zinc and is operating in this zinc mode. From the area and weight of the sample plus the consideration of dilution factors, the content of zinc is readily calculated on the basis of area or in parts per million of sheet. The background zinc determination which is used as a correction factor is performed exactly as described above but on an uncoated counterpart of sheet.

EXAMPLE 5

Zinc-traced coated sheets are prepared by methods similar to those described in Example 1 and then used to prepare cigar products which in turn are subjected to smoking analyses in order to determine the extent of carryover of the added zinc into the mainstream smoke condensate. These data establish that the zinc tracer fulfilled toxicological requirements. The studies forming the content of this example are carried out using zinc nitrate as the tracer at three approximate levels of added zinc based on the weight of the wrapper: 0 ppm added zinc (control), 350 ppm added zinc (1X level zinc) and 4,000 ppm added zinc (10X level zinc). (Note: the 1X level zinc refers to a zinc/EC ratio of 1/39.3 and the 10X level zinc refers to a ratio of 1/3.53. These are actual found ratios although at the time of makeup, the solutions are calculated to have ratios of 1/33 and 1/3.3 respectively.) Zinc levels in the wrapper may be easily calculated from the data as contained at the bottom of Table 2-e.g., $$\frac{44}{3.1} = x \text{ (the amount of coating in mg./g sheet)} = 14$$

then $$\frac{1}{39.3} = \frac{x}{14} \text{ where } x = 356 \text{ ppm zinc and}$$

$$\frac{1}{3.53} = \frac{x}{14} \text{ where } x = 3{,}967 \text{ ppm zinc.}$$

The zinc-traced coated sheets, as well as the controls, are then used as cigar wrapper to make perfecto and cigarillo shaped cigars on automatic machinery. All samples are then conditioned for at least 72 hours at 70° F. and 60% relative humidity prior to smoking analysis. Smoking is carried out on an automatic smoking machine using the following regime: A 35 ml. puff volume is collected over a two-second period at an interval of one minute until ⅔ of the total cigar is smoked. Collection of mainstream tars (condensate) is however *not* carried out on Cambridge filter pads since laboratory studies indicated that these pads contained a high and variable content of zinc (300 to 700 μg. of zinc/blank pad). Collection is therefore carried out using cold acetone traps. The tobacco smoke condensate is trapped in two vacuum traps containing approximately 100 ml of acetone. The two traps cooled in an ice-bath are used in series. The efficiency of the traps is assessed by placing a Cambridge filter pad holder between the smoking machine and the second acetone trap. Less than 1 milligram of tar is found on the filter pad after the smoke passed through the two acetone cold traps. This represents an efficiency for trapping 99%. The actual analyses are carried out as follows:

(a) Zinc Content of Whole Cigar

The cigarillo and perfecto samples are weighed in duplicate and wet ashed with 30 ml of 1:1 mixture of concentrated nitric and perchloric acids, until complete oxidation occurred. The resultant solution is filtered and the residue is washed with 5N Nitric acid and filtered. The filtrate is evaporated to approximately 2 ml and made to volume with distilled water in 50 ml volumetric flasks. Blanks are prepared exactly as described above except for the omission of tobacco. Similarly, zinc standards are prepared in distilled water containing the acid content equivalent to that of the samples. Analysis of zinc is by atomic absorption. The data are reported in Table 2.

(b) Zinc Content in Mainstream Smoke

The acetone from the cold traps containing the smoke condensate is evaporated to dryness and the residue wet ashed with 20 ml of 1:1 mixture of concentrated nitric and perchloric acids. The solution is evaporated to approximately 2 ml and made to volume with distilled water in 25 ml volumetric flasks. The blanks and standards are prepared exactly as described in (a) above. The data are also reported in Table 2.

All values presented in Table 2 represent the average of at least two determinations and in most cases an average of three determinations. Inspection of Table 2 reveals the following:

(a) At levels of 1X zinc as a coating tracer (these are the preferred levels, i.e., where the zinc/EC ratio is approximately 1/33 or less), the total amount of added zinc on the basis of the whole cigar amounts to an increase of about 5 to 20% over background zinc depending on the size of the cigar;

(b) The amount of added zinc found corresponds well with the calculated values;

(c) Since there are only small quantities of added zinc, the increase in zinc in the mainstream condensate, even at the 10X levels, reveals small numbers even when increases of 2X to 3X over control zinc are obtained;

(d) Regardless of the amount of added zinc (i.e., up to 10X level), there is no apparent large increase in percentage of zinc carryover above and beyond that obtained in the control indicating that the added zinc undergoes the same combustion pattern as the control.

From a toxicity point of view, zinc, as a tracer for coating, seems to satisfy the requirements for toxicity acceptance.

EXAMPLE 6

This example is the same as Example 5 except for the following:

(a) The zinc salt used as a tracer is zinc chloride (the preferred tracer) at the 1X level (i.e., approximately 1/33, zinc/EC) and ½X level (i.e., approximately 1/66, zinc/EC).

(b) Carryover studies are performed with cigarillos.

(c) The applicable coating data follow (1) 1X level

Found Ratio zinc/EC=1/30.8

Determined Coating level=53 mgm/sq/ft.

Sheet Weight=3.1 gm/sq/ft.

Therefore:

$53/3.1=x/1=17.1$ mg coating/gm sheet $1/30.8=x/17.1=0.555$ mg/gm sheet=555 ppm Zinc in Wrapper.

(2) ½X level

Found Ratio zinc/EC=1/66.94

Determined Coating level=71.43 mg/sq.ft.

Sheet Weight=3.1 g/sq.ft.

Therefore:

$71.43/3.1=x/1=23.0$ mg coating/gm sheet $1/66.94=x/23.0=0.344$ mg/gm sheet=344 ppm Zinc in Wrapper.

Data are presented in Table 3 and indicate no abnormal increases in percentage zinc carryover above and beyond the control data.

EXAMPLE 7

This example is the same as Example 5 except for the following:

(a) The zinc salt used as a tracer is zinc acetate at the ½X level (i.e., approximately 1/66, zinc/EC and ¼ level (i.e., approximately 1/132, zinc/EC).

(b) Carryover studies are performed with cigarillos.

(c) The applicable coating data follow:

(1) ½X level

Found ratio zinc/EC=1/66.23

Determined Coating level=34.0 mg/sq.ft.

Sheet Weight=3.1 gm/sq.ft.

Therefore $34.0/3.1=x/1=10.96$ mg coating/gm. sheet $1/66.23=x/10.96=166$ ppm zinc in wrapper (2) ¼ x level Found ratio zinc/EC=1/139.33

Determined Coating level=38.1 mg/sq.ft

Sheet Weight=3.1 gm/sq. ft.

Therefore $38.1/3.1=x/1=12.3$ mg coating/cm. sheet $1/139.33=x/12.3=88$ ppm zinc in wrapper Data are represented in Table 4 and indicate that the zinc carryover, when using the zinc salt of an organic acid, is higher than those obtained with zinc salts of inorganic acids.

TABLE 1

| Bobbin No. | *MGM OF COATING PER SQUARE FOOT SHEET | | | | | |
|---|---|---|---|---|---|---|
| | Zinc Nitrate | | Zinc Acetate | | Zinc Chloride | |
| | 84-1 (single) | 84-2 (dual) | 84-3 (single) | 84-4 (dual) | 84-5 (single) | 84-6 |
| 1 | 32.3 | 71.0 | 36.2 | 64.0 | 30.2 | 56.1 |
| 3 | 24.9 | 58.8 | 26.5 | 66.2 | 26.6 | 58.4 |
| 5 | 21.4 | 51.3 | 22.0 | 59.8 | 22.3 | 48.1 |
| 6 | 20.7 | 49.3 | 23.3 | 61.6 | 23.8 | 52.0 |
| 8 | 23.4 | 61.1 | 24.8 | 66.2 | 25.8 | 58.6 |
| 10 | 23.7 | 68.7 | 26.4 | 58.2 | 24.9 | 57.1 |
| 11 | 26.7 | — | 34.9 | 60.5 | 30.1 | 51.4 |
| Coating Level Range (mgm) | 11.6 | 21.7 | 14.2 | 8.0 | 7.9 | 10.5 |

*Each value average of at least two separate determinations.

TABLE 2

| Sample | % Zinc Transferred to Smoke from Whole Cigar (Zinc Nitrate) | | | | |
|---|---|---|---|---|---|
| | μgm Zinc in Whole Cigar | μgm Zinc Added | | μgm Zinc in Mainstream | % Zinc Transferred to Smoke from Whole Cigar |
| | | Found[1] | Calculated[2] | | |
| Cigarillo | | | | | |
| Control | 176.2 | — | — | 3.0 | 1.7 |
| 1X Zinc | 211.2 | 35 | 61 | 5.1 | 2.4 |
| 10X Zinc | 730.0 | 554 | 677 | 9.4 | 1.3 |
| Perfecto | | | | | |
| Control | 368.8 | — | — | 7.8 | 2.1 |
| 1X Zinc | 386.2 | 17 | 95 | 10.0 | 2.6 |
| 10X Zinc | 1312.5 | 944 | 1065 | 17.5 | 1.3 |

[1]These values are derived by subtracting the actual value of zinc from the control e.g., 211.2-176.2 = 35

[2]Based on a typical cigar weight: Perfecto 7.4 gm, Cigarillo 3.8 gm; a coating of 44 mgm/sq.ft.; a sheet weight of 3.1 gm/sq.ft.; a zinc level which was for the 1X, 1 mgm Zn in 39.33 39.3 of coating and for the 10X, 1 mgm Zn in 3.53 mgm of coating; also for cigars with the following % by weight wrapper, Perfecto 3.58, Cigarillo 4.89.

TABLE 3

| Sample | % Zinc Transferred to Smoke from Whole Cigar (Zinc Chloride) | | | | |
|---|---|---|---|---|---|
| | μgm Zinc in Whole Cigar | μgm Zinc Added Found[1] | μgm Zinc Added Calculated[2] | μgm Zinc in Mainstream | % Zinc Transferred to Smoke from Whole Cigar |
| Cigarillo | | | | | |
| Control | 175 | — | — | 6.7 | 3.8 |
| 1X Zinc | 258 | 83 | 74 | 7.8 | 3.0 |
| 10X Zinc | 225 | 50 | 46 | 9.2 | 4.1 |

[1]See Bottom of Table 2.
[2]Using an average cigarillo weight of 2.7243 and an average % by weight of wrapper of 4.89.

TABLE 4

| Sample | % Zinc Transferred to Smoke from Whole Cigar (Zinc Acetate) | | |
|---|---|---|---|
| | μgm Zinc in Whole Cigar | μgm Zinc in Mainstream | % Zinc Transferred to Smoke from Whole Cigar |
| Cigarillo | | | |
| Control* | | | |
| ½X Zinc | 177 | 9.4 | 5.3 |
| ¼X Zinc | 199 | 14.9 | 7.5 |

*No Control was run in this experiment.

What is claimed is:

1. A reconstituted tobacco sheet coated on at least one surface thereof with a hydrophobic coating comprising ethylcellulose and substantially uniformly dispersed therein, a spectrophotometrically-determinable, pharmacologically-acceptable metal cation, naturally occurring in tobacco wherein the weight ratio of said metal cation to ethyl cellulose is from about 1:30 to about 1:80, and said metal cation is present in said coating in a proportion at least three times the amount naturally-occurring in said tobacco sheet, the quantity of said coating per unit area of said sheet varying less than about 5% along the sheet length.

2. A reconstituted tobacco sheet according to claim 1 wherein said metal cation is present in the form of a tobacco-acceptable salt.

3. A reconstituted tobacco sheet according to claim 2 wherein said salt is the salt of an inorganic acid.

4. A reconstituted tobacco sheet according to claim 1 wherein said metal is zinc, cesium, lithium, copper or barium.

5. A cigar, the wrapper of which comprises the reconstituted tobacco sheet of claim 1.

6. The reconstituted tobacco sheet of claim 1, wherein said metal cation is zinc.

7. A reconstituted tobacco sheet according to claim 6 wherein the zinc ion is present as a salt of an inorganic acid.

8. A reconstituted tobacco sheet according to claim 6, wherein the zinc ion is present as zinc chloride.

9. A cigar, the wrapper of which comprises the reconstituted tobacco of claim 6.

10. The reconstituted tobacco sheet of claim 6, wherein the zinc ion is present at a level of 150 to 400 ppm.

11. A method of monitoring the uniformity of a hydrophobic coating on a reconstituted tobacco sheet, said coating including a substantially uniformly dispersed spectrophotometrically-determinable, pharmacologically-acceptable metal cation, which comprises spectrophotometrically measuring the level of metal contained in the coating on unit areas along the length and/or width of the coated sheet.

12. A method according to claim 11 wherein said cation is zinc.

13. A method according to claim 12 wherein zinc cation is present as zinc chloride.

14. A method according to claim 13 wherein said cation is present in a ratio of about 1:30 to about 1:80 parts of said coating.

15. A method according to claim 11 wherein said coating comprises ethyl cellulose.

16. A process for producing a reconstituted tobacco sheet for cigar wrapper comprising applying a hydrophobic coating to reconstituted tobacco sheet, said coating including, substantially uniformly dispersed therein, a spectrophotometrically-determinable pharmacologically-acceptable metal cation, spectrophotometrically measuring the level of metal contained in the coating on unit areas along the length and/or width of the coating sheet, and responsively controlling the quantity and distribution of coating applied to said reconstituted tobacco sheet to a selected level to provide a uniformly coated sheet.

17. The process of claim 16 wherein said metal cation is zinc, cesium, lithium, copper or barium.

18. The process of claim 16 wherein the metal cation is zinc.

19. The process of claim 18 wherein the zinc cation is present as the salt of an inorganic acid.

20. The process of claim 18 wherein the zinc cation is present as zinc chloride.

21. The process of claim 18 wherein the coating comprises ethyl cellulose.

22. The process of claim 21 wherein the weight ratio of zinc to ethyl cellulose is from about 1:30 to about 1.80.

23. A cigar, the wrapper of which comprises the reconstituted sheet prepared according to the process of claim 16 wherein the quantity of said coating per unit area of said sheet varies less than about 5% along the sheet length.

* * * * *